US005745085A

United States Patent [19]

Tomio et al.

[11] Patent Number: 5,745,085

[45] Date of Patent: Apr. 28, 1998

[54] DISPLAY PANEL AND DRIVING METHOD FOR DISPLAY PANEL

[75] Inventors: Shigetoshi Tomio; Toshio Ueda, both of Kawasaki, Japan

[73] Assignee: Fujitsu Limited, Kawasaki, Japan

[21] Appl. No.: 412,137

[22] Filed: Mar. 28, 1995

Related U.S. Application Data

[63] Continuation-in-part of Ser. No. 384,371, Feb. 2, 1995, which is a continuation of Ser. No. 188,909, Jan. 31, 1994, abandoned.

[30] Foreign Application Priority Data

Dec. 6, 1993 [JP] Japan ..... 5-305415

[51] Int. Cl.[6] ..... G09G 3/30

[52] U.S. Cl. ..... 345/63; 345/77

[58] Field of Search ..... 345/60, 63, 77, 345/67, 4–6, 76

[56] References Cited

U.S. PATENT DOCUMENTS

| | | | |
|---|---|---|---|
| 4,032,818 | 6/1977 | Chan | 345/63 |
| 4,414,544 | 11/1983 | Suste | 345/63 |
| 4,692,665 | 9/1987 | Sakuma | 345/60 |
| 4,859,910 | 8/1989 | Iwakawa et al. | 345/60 |
| 5,068,740 | 11/1991 | Brody | 345/903 |
| 5,126,632 | 6/1992 | Parker | 345/4 |
| 5,325,107 | 6/1994 | Ogawa et al. | 345/77 |

FOREIGN PATENT DOCUMENTS

| | | |
|---|---|---|
| 1-193797 | 8/1989 | Japan . |
| 3-182792 | 8/1991 | Japan . |
| 3-269482 | 12/1991 | Japan . |
| 4-128874 | 4/1992 | Japan . |
| 5-181430 | 7/1993 | Japan . |

*Primary Examiner*—Victor R. Kostak
*Attorney, Agent, or Firm*—Staas & Halsey

[57] ABSTRACT

A flat panel display operates at a low level of power consumption without limiting a display rate and produces an image display of stable brightness, suppressing any change in brightness resultant from a change in the display rate or in a level of a display voltage, Vs. A turn on frequency control unit controls the turn on frequency of the display as a function of the frequency of discharge-sustaining voltage pulses, a current detecting unit detects a level of current flowing into the cell portions of the display panel, and a current converting value setting unit arbitrarily sets a converging value of the current that flows into the cell portions.

20 Claims, 16 Drawing Sheets

13
18
12
15
70
14
13
DIELECTRIC LAYER (18)
GLASS SUBSTRATE (12)
(15)
Y ELECTRODE (15)
70
(14)
X ELECTRODE (14)

Fig.14

| CODE NUMBER | NUMBER OF TIMES OF SUSTAINED DISCHARGE/SCREEN | LIGHT EMIT SYNC | 7 BIT CODE |
|---|---|---|---|
| 0 | 504 | 30.24 | 0000000 |
| 1 | 497 | 29.82 | 0000001 |
| 2 | 494 | 29.64 | 0000010 |
| 3 | 490 | 29.40 | 0000011 |
| 4 | 487 | 29.22 | 0000100 |
| - | - | - | - |

DISPLAY PANEL AND DRIVING METHOD FOR DISPLAY PANEL

CROSS REFERENCE TO RELATED APPLICATION

This application is a continuation-in-part application of Ser. No. 08/384,371 filed on Feb. 2, 1995 which is a File wrapper continuation of Ser. No. 08/188,909 filed Jan. 31, 1994, now abandoned.

BACKGROUND OF THE INVENTION

1. Field of the Invention

This invention relates to a display panel and, more particularly, to a flat-display panel providing stable brightness irrespective of changes in the display voltage applied to the display panel.

2. Description of the Related Art

In recent years, demand has increased for flat matrix displays, using a fluorescent substance to provide color displays, such as AC-type PDP (AC-type plasma display), DC-type PDP (DC-type plasma display), LCD (liquid crystal displays) and EL (electroluminescence) displays, to substitute for CRTs owing to their advantages of reduced depth, as well as to provide flat-display panels utilizing emission of light by a gas to obtain monochromatic displays. Recently, in particular, demand is increasing for color displays.

Flat-display panels implemented, for example, as plasma displays, electroluminescence (EL) displays, and etc., have reduced depths and have, hence, been utilized for realizing large display screens, and, further, are finding new applications and are being produced on ever larger production scales.

In general, a flat display permits an electric charge accumulated between electrodes to be discharged, upon application of a predetermined voltage, to emit light or luminescence which is used for display. The general principle of a plasma display will be briefly described below in connection with its constitution and operation.

Plasma displays (AC-type PDPS) that have heretofore been well known include those of the two-electrode type which effect selective discharge (address discharge) and sustained discharge using two electrodes and those of the three-electrode type which effect address discharge using a third electrode.

In the mean time, in a plasma display (PDP) which produces color display, a fluorescent substance which is formed in a discharge cell is excited by an ultraviolet rays generated by electric discharge. The fluorescent substance, however, has a defect in that it is weak against bombardment thereof by positively charged ions that are also generated by the electric discharge. With the above-mentioned two-electrode type display, the fluorescent substance is so arranged as to be directly exposed to the bombardment of ions and thus has a short life.

To avoid this, the color plasma displays generally employ a three-electrode structure to utilize a surface discharge.

The three-electrode type displays can be grouped into those in which the third electrode is formed on a substrate on which the first and second electrodes are arranged to sustain the discharge, and those in which the third electrode is disposed on another opposing substrate.

Besides, even when the above-mentioned three kinds of electrodes are formed on the same substrate, there will be a case where the third electrode is disposed over the two electrodes that sustain the discharge and a case where the third electrode is disposed under the two electrodes.

Moreover, visible light emitted from the fluorescent substance may be either viewed as it transmits through the fluorescent substance or as it is reflected by the fluorescent substance.

The flat-display panels of various types inclusive of those of the above-mentioned plasma displays all have the same operating principle, even though their constitutions and types may be more or less different. Therefore, concretely described below is a flat-display panel which is constituted by a first substrate having first and second electrodes for sustaining electric discharge and by a third electrode formed on a second substrate which is different from the first substrate and is opposed to the first substrate.

FIG. 7 is a schematic plan view showing the general constitution of the AC-type three-electrode plasma display panel (PDP) mentioned above, and FIG. 8 is a schematic sectional view of a discharge cell 10 of the plasma display panel shown in FIG. 7.

As will be understood from FIGS. 7 and 8, the plasma display panel is constituted by two glass substrates 12 and 13. The first substrate 13 includes first electrodes (X-electrodes) 14 that are disposed in parallel with one another and work as sustaining electrodes, and second electrodes (Y-electrodes) 15 which are covered with a dielectric layer 18.

Furthermore, on a discharge surface of the dielectric layer 18 is formed a film 21 composed of MgO (magnesium oxide) or the like which serves as a protective film.

On the surface of the second substrate 12 opposing the first glass substrate 13, there are formed electrodes 16 that work as third electrodes or address electrodes and intersect the sustaining electrodes 14 and 15 at right angles.

On the address electrode 16 is disposed a fluorescent substance 19 having any one of red, green and blue light-emitting properties on the same surface as the surface of the second substrate 12 on which the address electrode is disposed within a discharge space 20 defined by wall portions 17.

That is, each of the discharge cells 10 in the plasma display is partitioned by walls (barrier walls).

In the plasma display 1 of the embodiment, the first electrodes (X-electrodes) 14 and the second electrodes (Y-electrodes) 15 are arranged in parallel with each other to form pairs, the second electrodes (Y-electrodes) 15 being separately driven whereas the first electrodes (X-electrodes) 14 constituting a common electrode so as to be driven by a single driver.

FIG. 9 is a schematic block diagram showing peripheral circuits for driving the plasma display shown in FIGS. 7 and 8, wherein a display panel 30 having, for example, the structure as described above displays a predetermined picture being controlled by a panel driver circuit 31 which includes an address driver means for driving the address electrodes, and a driver means for separately driving the X- and Y-electrodes. A dot-clock signal which is an address data for driving the address electrodes and display data are input to a data control circuit 33. Upon receiving a predetermined address signal and a timing signal from a suitable frame memory, the above signals are input to the panel driver circuit 31 to drive a predetermined address electrode and to apply a predetermined display data to, for example, a predetermined cell portion of a selected Y-electrode.

On the other hand, a VSYNC signal, which is a vertical synchronizing signal output for every frame, and a signal HSYNC, which is a horizontal synchronizing signal output for every sub-frame, are both input to a scan control circuit 34 and are then input to the panel driver circuit 31 in response to a control signal input from the data control circuit 33, thereby to separately drive the X-electrode and the Y-electrode.

The scan control circuit 34 changes the frequency of the discharge-sustaining voltage pulses applied to the X- and Y-electrodes in order to sustain electric discharges in the above-mentioned selected cell portion and to control the brightness of the display screen. More specifically, a current detecting means 37 detects the current consumed by the display panel when a display voltage Vs is applied to the display panel, the value of which is converted into 8-bit digital data through an analog/digital converter 36, and then the 8-bit data is converted into, for example, a 7-bit control code through a microcontroller (MPU) 35, and is input to a sustain counter 45 provided in the scan control circuit 34, in order to suitably change the frequency of the discharge-sustaining pulses and to adjust the brightness.

Similarly, the constitution and operation of a conventional DC-type plasma display will be described below with reference to FIGS. 16 and 17. The basic constitution is the same as the AC-type plasma display shown in FIGS. 7 and 8.

As shown in FIG. 16, however, the electrodes arranged on the inner surfaces of the two opposing glass substrates 12 and 13 do not include the X-electrodes shown in FIG. 7, but include anodes (anode electrodes) Al to AM that correspond to address electrodes and cathodes (cathode electrodes) Kl to KN that correspond to Y-electrodes of FIG. 7 and that intersect the anodes (anode electrodes) at right angles. As shown in FIG. 17, the panel 10 is constituted by disposing two glass substrates, i.e., the front glass substrate 12 and the rear glass substrate 13, in an opposing manner as in FIG. 8. A mixture gas comprising, for example, helium He and xenon Xe is sealed between the two glass substrates, and a predetermined discharge space is formed by suitable wall portions 17.

In the DC-type plasma display shown in FIGS. 16 and 17, neither the dielectric layer 18 nor the MgO film 21 shown in FIG. 8 is needed, since direct current is used.

In the thus constituted panel, a suitable voltage is applied across the cathode KN and the anode AM whereby electric discharge takes place in a space partitioned by the wall portions 17, i.e., between the cathode KN and the anode AM in the display cell, and the fluorescent substance is excited by ultraviolet rays produced at this moment to thereby emit light.

In the DC-type plasma display, light is emitted due to discharge as long as a predetermined DC voltage is applied across the above-mentioned two electrodes.

In the above-mentioned conventional flat-display panel as described with reference, for example, to the DC-type plasma display (DC-PDP) as shown in FIGS. 10 and 11, the brightness of the display panel 30 in the plasma display (DC-PDP) abruptly increases with an increase in the discharge voltage pulse. That is, when attention is given to a discharge spot unit 70 at a cell portion 10 constituted at an intersecting point of the anode electrode AM and the cathode electrode KN, the discharge area of the discharge spot 70 abruptly increases with an increase in the discharge voltage pulse as represented by a change from FIG. 10(A) to FIG. 1O(B), and the dot brightness at the light-emitting portion increases.

Similarly, even in the case of the surface discharge-type cell portion in the AC-type plasma display (AC-PDP) as shown in FIGS. 11(A) and 11(B), the discharge spot 20 occurs only inside the discharge gap when the applied voltage is small, as shown in FIG. 11(A), but the area of the discharge spot 70 increases with an increase in the voltage as shown in FIG. 11(B), and brightness at the light-emitting portion increases.

It has been known that the electric power consumed by the above-mentioned conventional flat-display panel increases in proportion to the current when the applied voltage is constant and the current varies in proportion the light-emitting frequency.

Therefore, in the prior art flat-display panel, when the turn-on area or the turn-on display rate increases, the electric current is detected and the light-emitting frequency is controlled to maintain the current constant.

Specifically, in the circuit constitution of the prior art flat-display panel shown in FIG. 9, the high voltage Vs for display applied to the display is input to the panel drive circuit 31 through the current detecting circuit 37, the detected current value is converted into 8-bit data through the 8-bit A/D converter 36 and is input to a calculation unit or MDU (constituted by a microcontroller, etc.) 35 which determines whether the detected current value is larger than a preset current converging value. When the detected current value is larger than the current converging value, the frequency of the discharge-sustaining pulses is lowered to maintain the current value constant.

Here, a frequency conversion control signal for the discharge-sustaining pulses is output in the form of a 7-bit code from the calculation means 35 to the scan control circuit 34.

FIGS. 12 and 13 are graphs respectively showing the relationship between the current $I_s$ flowing into the display panel, and the brightness and frequency of discharge-sustaining pulses (sustaining pulses) using the display voltage Vs as a parameter when the display rate (%) is changed in the flat-display panel of the prior art.

That is, as described above, due to the characteristics of the prior art flat-display panel, the current $I_s$ increases with an increase in the display rate as shown in FIG. 12, and a difference develops depending upon the voltage Vs, as represented by curve a and curve b. Namely, the curve a shows a case when the voltage Vs is large, and the curve b shows a case when the voltage Vs is small.

In effect, in the prior art flat-display panel, the current value increases in proportion to an increase in the display rate, from which it will be understood that the degree of increase becomes large as the voltage Vs increases.

As shown in FIG. 13, on the other hand, it will be understood that the brightness tends to decrease as the display rate increases, and the degree of brightness becomes higher as the voltage Vs becomes higher, as represented by a curve e, and the brightness decreases as the voltage Vs becomes small, as represented by a curve d.

As will be understood from curves f and g of FIG. 13, furthermore, the level of brightness can be changed depending upon the display rate by changing the frequency. When the frequency is not changed, the brightness changes as represented by curves d and e inclusive of dotted line curves in FIG. 13 and when the frequency is changed, the brightness can be changed as represented by solid line curves d' and e'.

According to the conventional flat-display panel, as will be understood from the above-mentioned analysis, an increase in the display rate results in an increase in the current, whereby the electric current is consumed in an increased amount and the panel becomes no longer economical.

It will be further understood that the level of brightness decreases with an increase in the display rate and there exists a large difference in the brightness depending upon a difference in the display voltage Vs.

Therefore, for the purpose of decreasing power consumption, in the prior art, when the display rate exceeds, for example, 50%, the frequency of the discharge-sustaining pulses is lowered so that a current larger than a predetermined value will not flow, i.e., so that the current will not become larger than a predetermined value as represented by a solid curve c in FIG. 12.

In order to fix the current to a predetermined value as shown in FIG. 12, the current flowing into the display panel should be decreased by lowering the frequency as represented by curves f and g in FIG. 13.

Here, however, the brightness decreases with a decrease in the frequency as a matter of course.

Therefore, the problem is how to attain the optimum display rate and brightness with the optimum current consumption by adjusting the above-mentioned factors.

In the prior art, a maximum current is set depending upon the specifications as described above. Therefore, the maximum current must be determined by taking the worst conditions into account. A setpoint voltage must have a margin and, hence, must be determined with a maximum display voltage Vs as a reference.

That is, a limit current is determined by the maximum value of the display voltage Vs and, hence, the brightness is determined accordingly.

On the other hand, the brightness differs to a considerable degree depending upon the difference in the setpoint voltage, i.e., on the display voltage Vs. Therefore, the brightness undergoes a change depending upon a change in the setpoint display voltage Vs, causing the quality of image to deteriorate.

SUMMARY OF THE INVENTION

It is an object of this invention to provide a display panel of a low power consumption type which is not affected by the display rate, as well as to provide a display panel capable of displaying an image while maintaining stable brightness and suppressing changes in the brightness regardless of a change in the display rate or a change in the setpoint display voltage Vs, by improving the aforementioned defects inherent in the prior art.

In order to accomplish the above-mentioned object, the present invention employs the technical constitution that is described below. That is, a display panel in which at least two electrode arrays having a plurality of electrodes forming cell portions that constitute pixels, and said cell portions have a function for emitting light in accordance with suitable display data and drive voltage pulses applied to said electrodes, characterized by the provision of a control means for controlling a current which increases with an increase in the turn-on display rate of said cell portions, a current detecting means for detecting the current flowing into said cell portions, and a current converging value setting means for arbitrarily setting a converting value of the current flowing into said cell portions.

In order to solve the above-mentioned problems inherent in the prior art, the flat-display panel according to the present invention employs the technical constitution that is described above. Basically, therefore, the invention is based on a technical idea in which attention is given to the electric power, i.e., the electric power is maintained constant and, under this condition, the current to be converged is increased when the voltage is low, i.e., when the display voltage Vs is low, making it possible to increase the brightness.

Specifically, either in the DC-type plasma display or the AC-type plasma display, the frequency is changed by changing the current converging value depending upon the display voltage Vs, whereby the difference in the brightness due to a difference in the display voltage Vs is minimized in order to realize an image display maintaining stable brightness.

More specifically, when the display voltage Vs is low, the level of the current value to be converged is set to be high whereby the frequency of drive voltage pulses is increased to increase the brightness. Accordingly, the level of brightness becomes high when the display voltage Vs is low and is brought close to the brightness level of when the display voltage Vs is high. Thus, a change in the brightness caused by a difference in the display voltage Vs is decreased.

BRIEF DESCRIPTION OF THE DRAWINGS

FIG. 14 is a diagram showing an example of frequency control data used in the flat-display panel according to this invention.

DETAILED DESCRIPTION OF THE PREFERRED EMBODIMENTS

An embodiment of a flat-display panel of the present invention will now be described in detail, specifically, in connection with an AC-type plasma display with reference to the drawings. It should, however, be noted that the invention is in no way limited to such an embodiment only but can also be adapted to a DC-type plasma display, as a matter of course, as mentioned earlier.

As mentioned earlier, the basic constitution of the flat-display panel of the present invention is concerned with a flat-display panel in which at least two electrode arrays, each having a plurality of electrodes, define cell portions that constitute pixels, and said cell portions have a function of emitting light in accordance with suitable display data and drive voltage pulses applied to said electrodes, characterized by the provision of a control means for controlling a current which increases with an increase in the turn-on display rate of said cell portions, a current detecting means for detecting the current flowing into said cell portions, and a current converging value setting means for arbitrarily setting a converging value of the current flowing into said cell portions. The flat-display panel may be a plasma display or an electroluminescence display. Moreover, a suitable fluorescent material may be inserted between the substrates. Furthermore, the drive voltage pulse may be a discharge-sustaining voltage pulse and the cell portion should have a function for emitting light upon discharge, in accordance with suitable display data and the discharge-sustaining voltage pulse applied to the electrodes.

It is further desired that the control means for controlling the current, that increases with an increase in the turn-on display rate of said display means, is a turn-on frequency control means which controls said current based upon the frequency of said drive voltage pulses.

Figure 1:
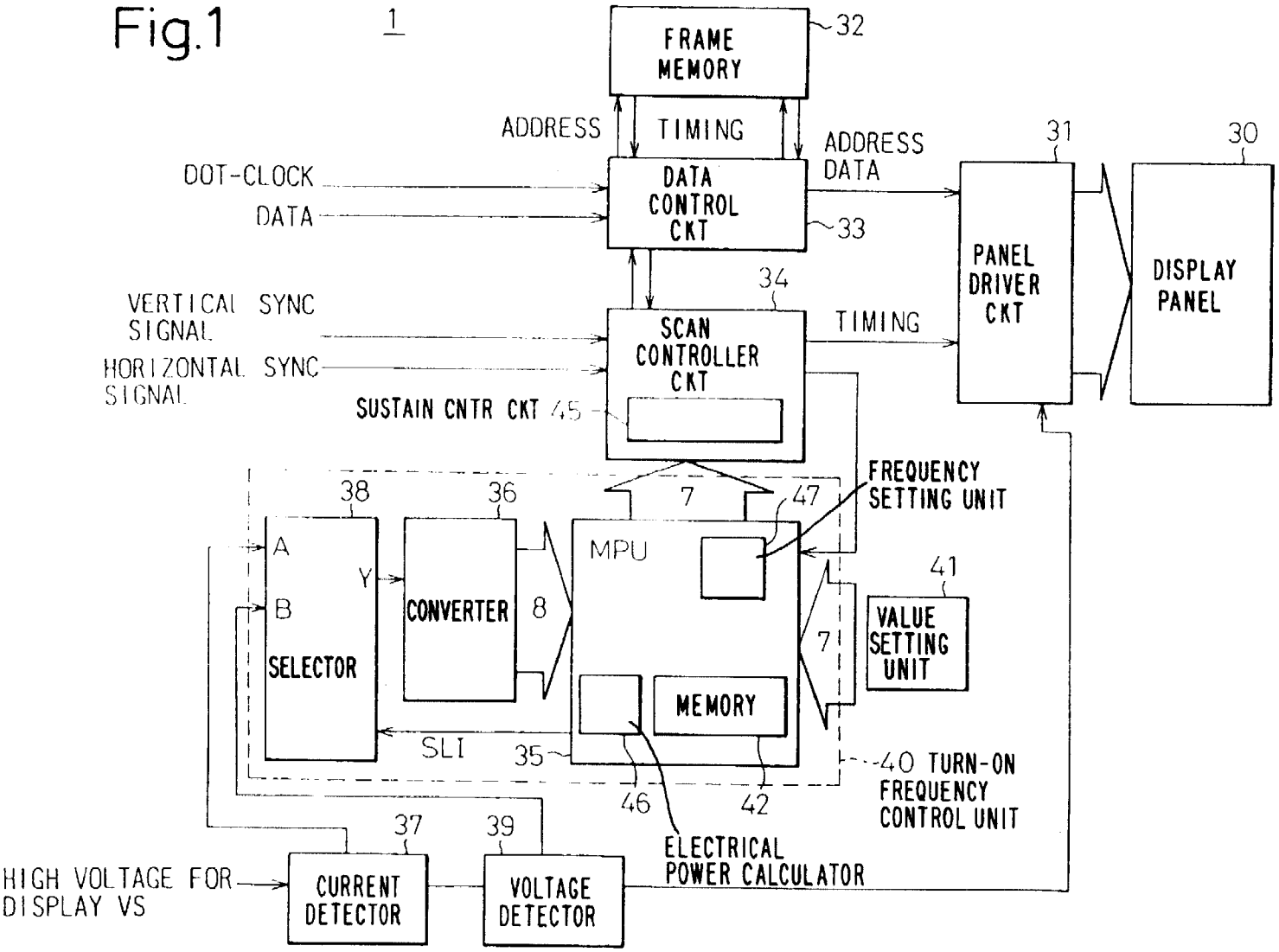
FIG. 1 is a block diagram illustrating the constitution of a flat-display panel according to an embodiment of this invention.

The embodiment of the flat-display panel of the present invention is shown in FIG. 1 which is a block diagram illustrating a concrete constitution of the flat-display panel of the invention, i.e., illustrating a flat-display panel in which at least two substrates having electrodes arranged on the surfaces thereof are disposed adjacent to each other so that said electrodes face each other at right angles, a suitable fluorescent substance is inserted between the substrates, a plurality of right-angled intersecting portions constituted between said electrodes have display-means-forming cell portions that constitute pixels, and said cell portions have a function for emitting light upon discharge in accordance with suitable display data and discharge-sustaining pulses applied to said electrodes, characterized by the provision of a turn-on frequency control unit for controlling a current which increases with an increase in the turn-on display rate of said display means based upon the frequency of said discharge-sustaining pulses, a current detecting means for detecting the current flowing into said cell portions, and a current converging value setting means for arbitrarily setting a converging value of the current flowing into said cell portions formed in the display means.

The flat-display panel according to the present invention may be a plasma display or an electroluminescence display. In the electroluminescence display, one substrate, on both opposite surfaces of which corresponding pluralities of electrodes are arranged, may be used.

According to the present invention, the flat-display panel 30 may be of any type, provided the cell portions constituting the display panel 30 of the flat-display panel are so constituted that the operation for emitting light upon discharge can be controlled by changing the frequency of the discharge-sustaining pulses.

Figure 9:
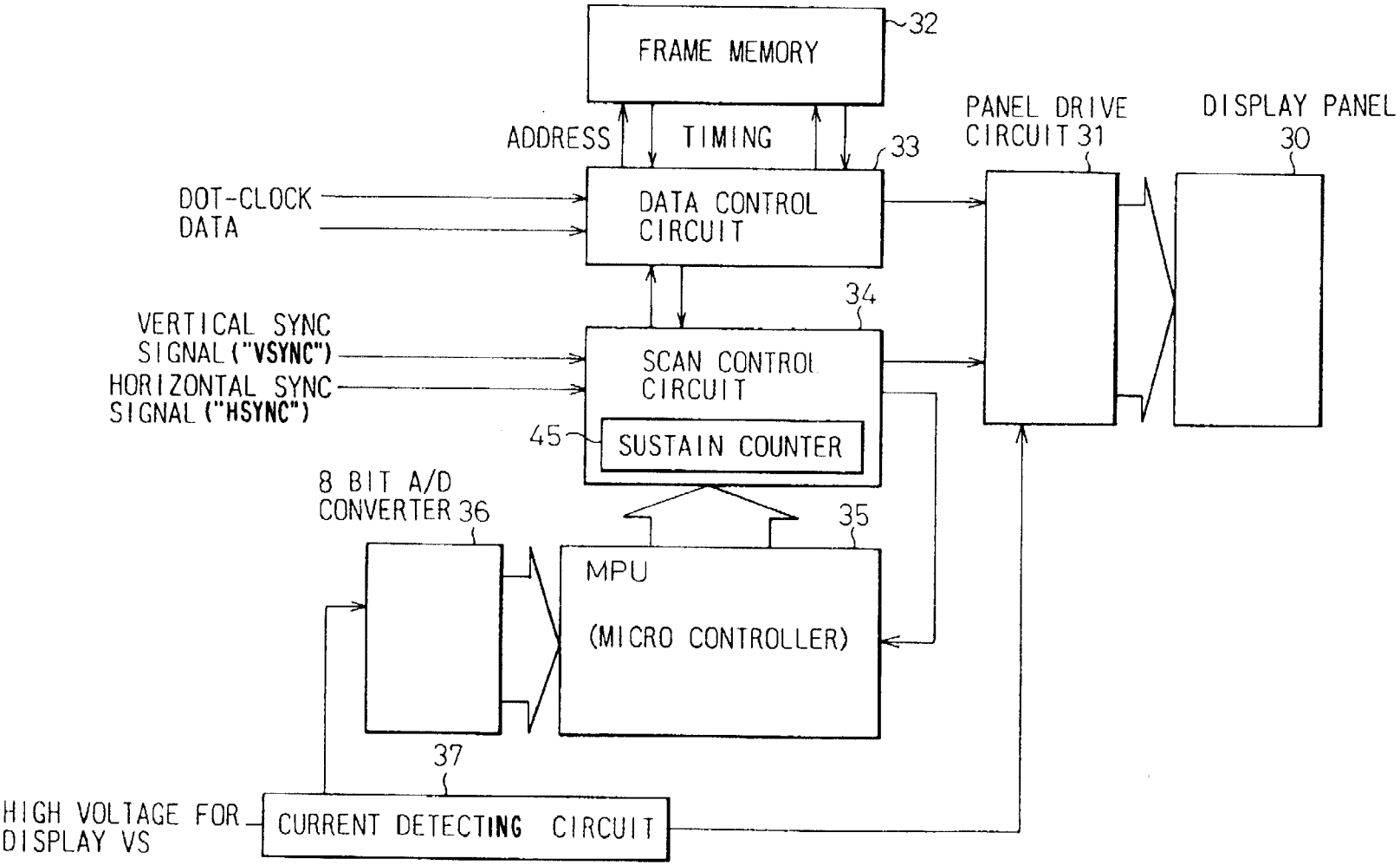
Fig. 9 PRIOR ART
FIG. 9 is a block diagram illustrating the constitution of a drive circuit in the prior art flat-display panel.
Figure 10A:
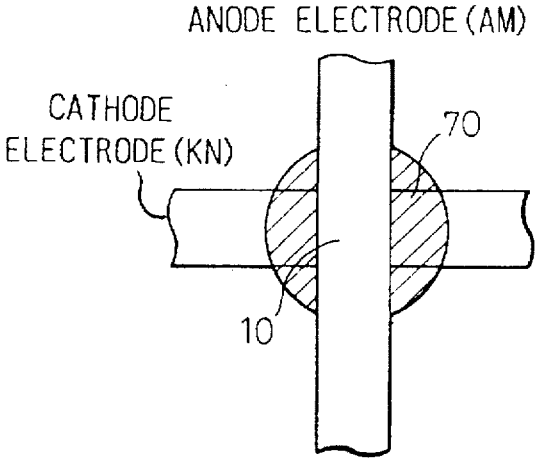
Fig.10(A) PRIOR ART
FIGS. 10(A) and 10(B) are diagrams showing the state of electric discharge in a cell portion in the prior art flat-display panel.
Figure 10B:
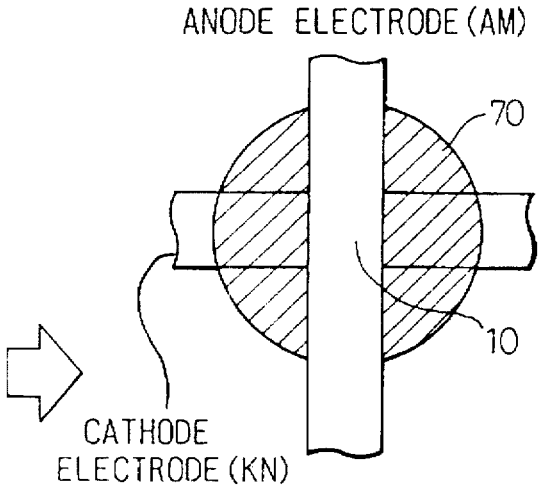
Fig.10(B) PRIOR ART
Figures 11A, 11B:
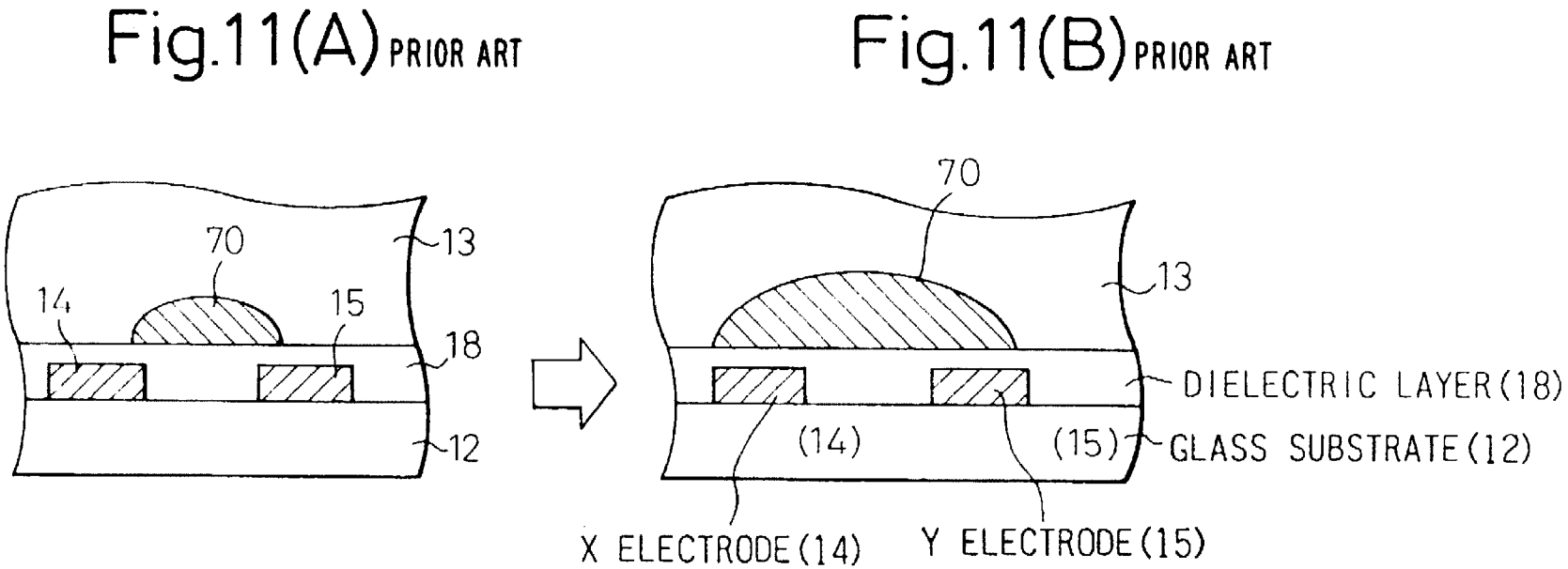
Fig.11(A) PRIOR ART
Fig.11(B) PRIOR ART
FIGS. 11(A) and 11(B) are diagrams showing the state of electric discharge in a cell portion in the prior art flat-display panel.
Figure 12:
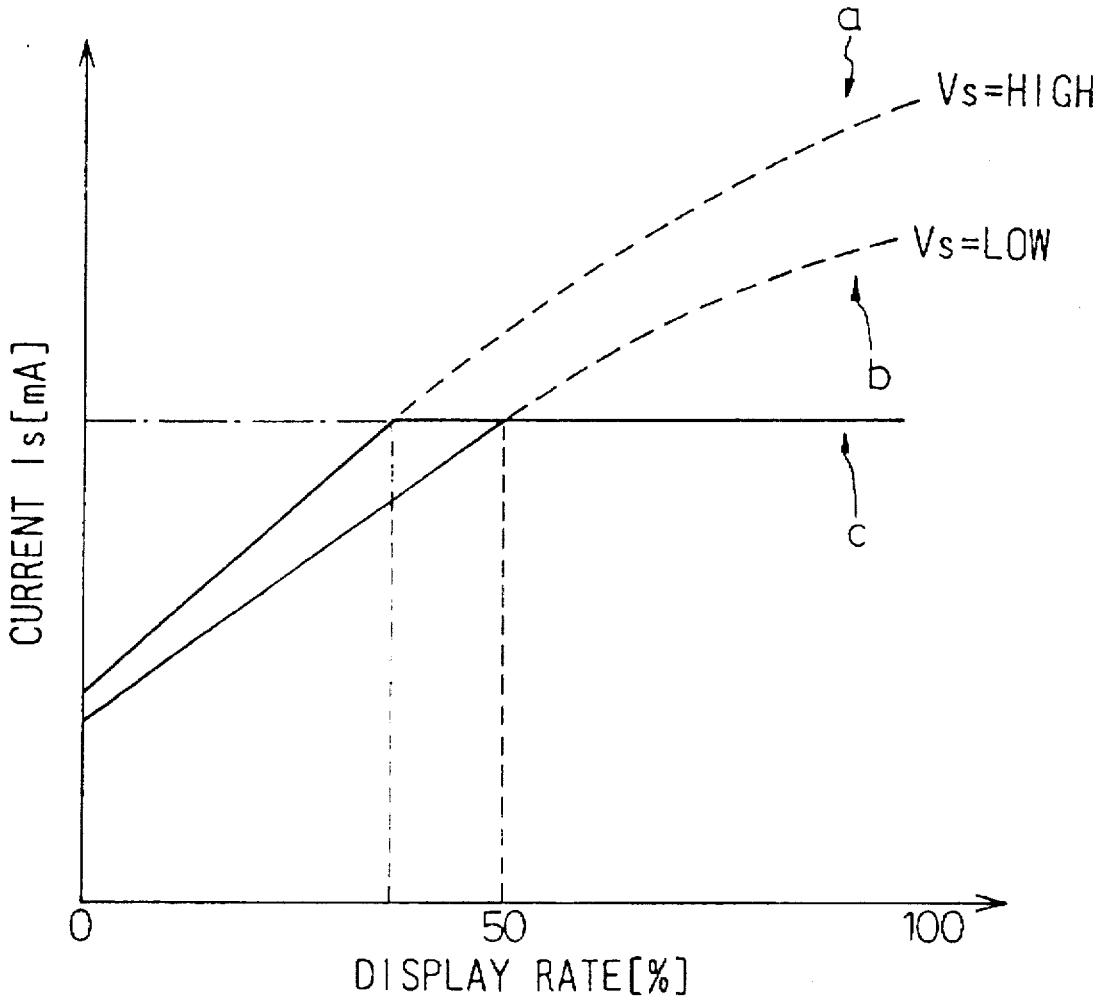
Fig.12 PRIOR ART
FIG. 12 is a graph showing the relationship between the display rate and the current during the display driving of a prior art flat-display panel.
Figure 13:
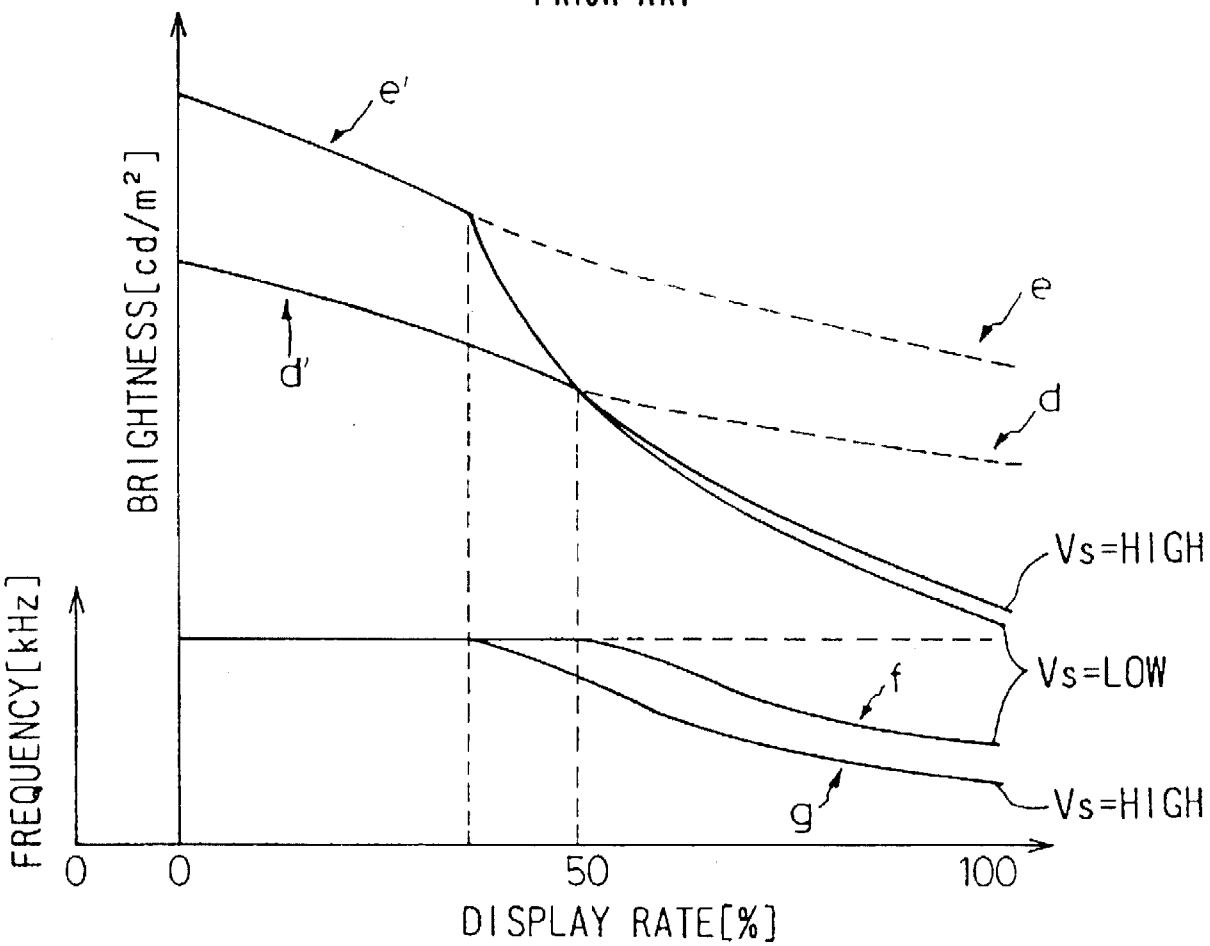
Fig.13 PRIOR ART
FIG. 13 is a graph showing the relationship between the display rate, the brightness and the frequency during the display driving of the prior art flat-display panel.

The basic constitution of the flat-display panel system according to the present invention shown in FIG. 1 is nearly the same as that of the prior art flat-display panel shown in FIG. 9, and the same circuits and same means are denoted by the same reference numerals but their details are not repeated here.

The characteristic constitution of the flat-display panel system 1 according to the present invention is as shown in FIG. 1, wherein a voltage detector 39 for detecting the display voltage Vs is disposed in series with a current detector 37, and an output of the voltage detector 39 and an output of the current detector 37 are separately input to a selector 38 which outputs predetermined data to the 8-bit A/C converter 36 in response to a suitable select command SL1, so that the 8-bit detected data is input to the microcontroller 35.

According to the present invention, a current converging value setting 41, which stores data related to predetermined current converging values, is connected to the microcontroller 35. Upon receiving a request signal from the microcontroller 35, the current converging value setting unit 41 reads the current converging value data, corresponding to the data of display voltage Vs received by the microcontroller 35, and sends the data to the microcontroller 35.

The microcontroller 35 sets a predetermined current converging value, based upon the control data, so that it can be used as a basis for the subsequent calculation.

Thus, the turn-on frequency control unit 40 in the flat-display panel system 1 in accordance with this invention so controls the frequency of the discharge-sustaining pulses of the cell portions that the current, flowing into the cell portions of the display panel 30, is converged into the current converging value set by the current converging value setting panel 41. In the concrete embodiment as shown in FIG. 1, use is made of the calculation panel 35, constituted by a microcontroller or the like, which is provided with a frequency setting unit 47 which changes the frequency of the discharge-sustaining pulses, which sustain the discharge, by alternatingly changing the polarity of the display voltage Vs applied to the cell portions of the display panel 30, relying upon the input current data and in compliance with a predetermined calculation program. The data for controlling the discharge-sustaining pulses are formed by the frequency setting unit 47 and are input to a sustain counter circuit 45 provided in the scan controller circuit 34.

When the frequency of the discharge-sustaining pulses increases due to the execution of the above-mentioned operation, the current increases. When the frequency of the discharge-sustaining pulses decreases, the current decreases. Thus, it is made possible to maintain the current at a predetermined value.

According to the present invention, the above-mentioned control operation can be executed relying basically upon the current data detected by the current detector 37. Furthermore, in order to realize the object of this invention more correctly and concretely, there may be further provided a voltage detector to detect the display voltage Vs, and conditions may be introduced so as to maintain the electric power constant by using both the current value and the display voltage value Vs, and the current value and the voltage value many be changed in order to accomplish the production of an image display which maintains a predetermined stable brightness while consuming a reduced amount of electrical power.

The flat-display panel system according to the present invention may be further provided with a voltage detector 39 for detecting the turn-on display voltage applied to the display 30, and with an electric power calculator unit 46 in the MPU 35, constituted by a microcontroller or the like, in order to calculate the power (voltage x current) value from an output of the voltage detector 39 and an output of the current detector 37 and in which the turn-on frequency control unit 40 may so control the frequency of the discharge-sustaining pulses that the power value is maintained constant.

Constitutions of the current detector 37 and voltage detector 39 used in the flat-display panel system 1 in accordance with this invention are not specifically limited, and any known detectors may be used. An example of the current detector 37 is shown in FIG. 2 and an example of the voltage detector 39 is shown in FIG. 3.

Figure 2:
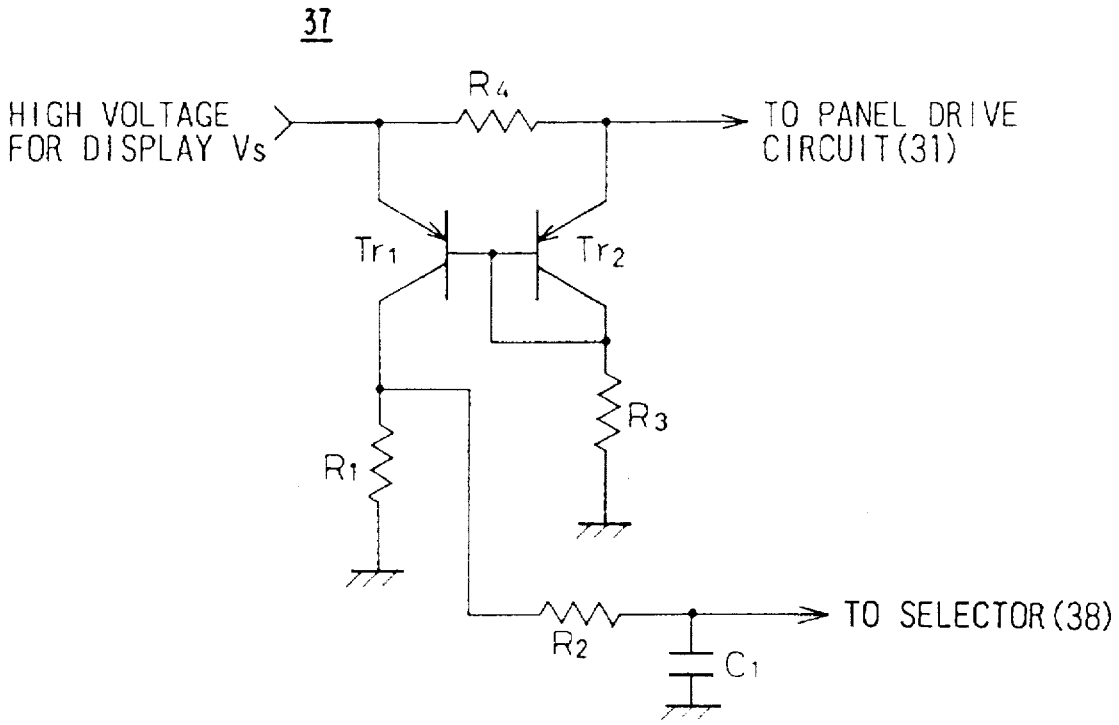
FIG. 2 is a block diagram illustrating the constitution of a current detecting means employed in the flat-display panel according to the embodiment of this invention.
Figure 3:
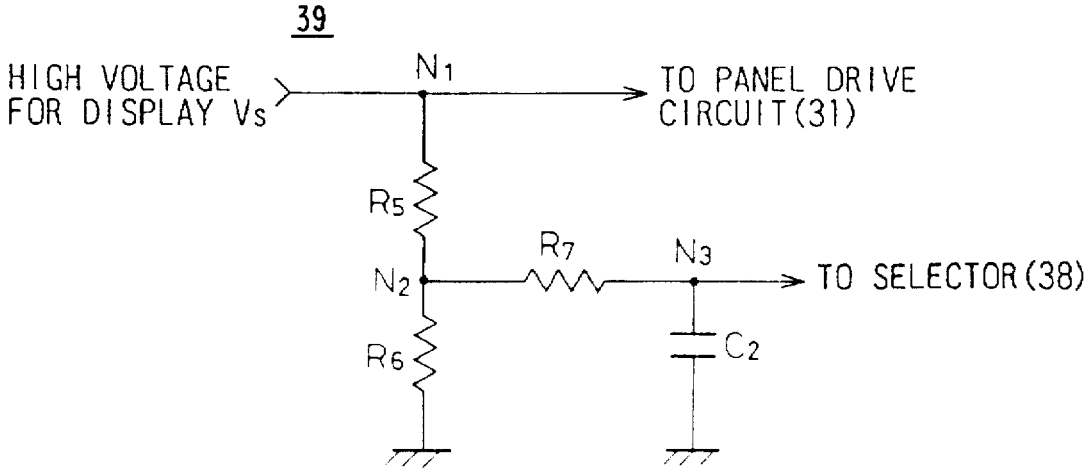
FIG. 3 is a block diagram illustrating the constitution of a voltage detecting means employed in the flat-display panel according to the embodiment of this invention.

FIG. 2 illustrates a concrete constitution of the current detector 37 used in the present invention.

According to this example, the current detector 37 is provided in the circuit which connects the power source of the display voltage Vs to the panel drive circuit 31; a resistor R4 is inserted in the circuit, the emitters of bipolar transistors TR1 and TR2 are connected to respective, opposite ends of the resistor R4, and the bases of the transistors TR1 and TR2 are connected in common.

The collector of the transistor TR2 is grounded via resistor R3 and is further connected to the base of the transistor TR2.

Further, the collector of the transistor TR1 is grounded via resistor R1 and is further connected to an end of a capacitor Cl via resistor R2, and the connection point, or node, thereof is connected to a comparator circuit 4 which will be described later.

The current value detected by the current detector 37 is input to a terminal A of the selector circuit 38 provided in the turn-on frequency control unit 40.

FIG. 3 illustrates the constitution of a display voltage Vs detecting circuit 39 that can be used in the present invention.

According to this example, the voltage detector 39 is provided in the circuit that connects the power source of the display voltage Vs to the panel drive circuit 31. Resistor R5 is connected to node N1 in the interconnecting circuit and in series at node N2 with resistor R6 and, further, resistor R6 is connected to ground. Resistor R7 is connected to node N2 and in series at node N3 with capacitor C2 and capacitor C2 further is connected to ground. A voltage detected at node N3, at which the resistor R7 and the capacitor C2 are connected together, is input to a terminal B of the selector circuit 38 provided in the turn-on frequency control unit 40.

The current and voltage according to this invention can be stored in a suitable memory 42 provided in the MPU 40, that is constituted by a microcontroller or the like, in the turn-on frequency control unit 40. In particular, the voltage value is specific to the display unit 30 that is used and, once it is measured, then the same voltage is obtained hereinafter. Accordingly, if a voltage measured first is stored in the memory means 42, the voltage data can be read out from the memory means 42 and can be used at any time.

For instance, the memory may store the data in such a manner that a first control data is used when a high voltage is detected, a second control data is used when an intermediate voltage is detected and a third control data is used when a low voltage is detected. Then, suitable control data can be read out from the memory depending upon a voltage that is subsequently detected.

As described above, furthermore, the current converging value setting unit 41 used in the present invention stores the control data related to an optimum current converging value that corresponds to a predetermined valve in the form of, for example, a look-up table, and feeds predetermined control data, corresponding to the detected voltage, to the turn-on frequency control unit 40.

The turn-on frequency control unit 40 is provided with a frequency setting unit 47 for attaining a proper brightness by taking into consideration the current and voltage values that are detected and the current converging data fed from the current converging value setting unit 41 under the condition where the electric power output from the electric power calculator 46 remains constant. The frequency setting unit 47 outputs a signal for controlling the scan control circuit 34 so as to accomplish a predetermined frequency of the discharge-sustaining pulses. In a concrete example, a look-up table is prepared in which control data related to the frequency for controlling the scan control circuit 34 are 7-bit coded. A predetermined control data is selected from the look-up table and is fed to the scan control circuit 34.

The look-up table is constituted by, for example, 128 steps of different frequency control data.

An example of the look-up table is shown in FIG. 14.

Figure 15:
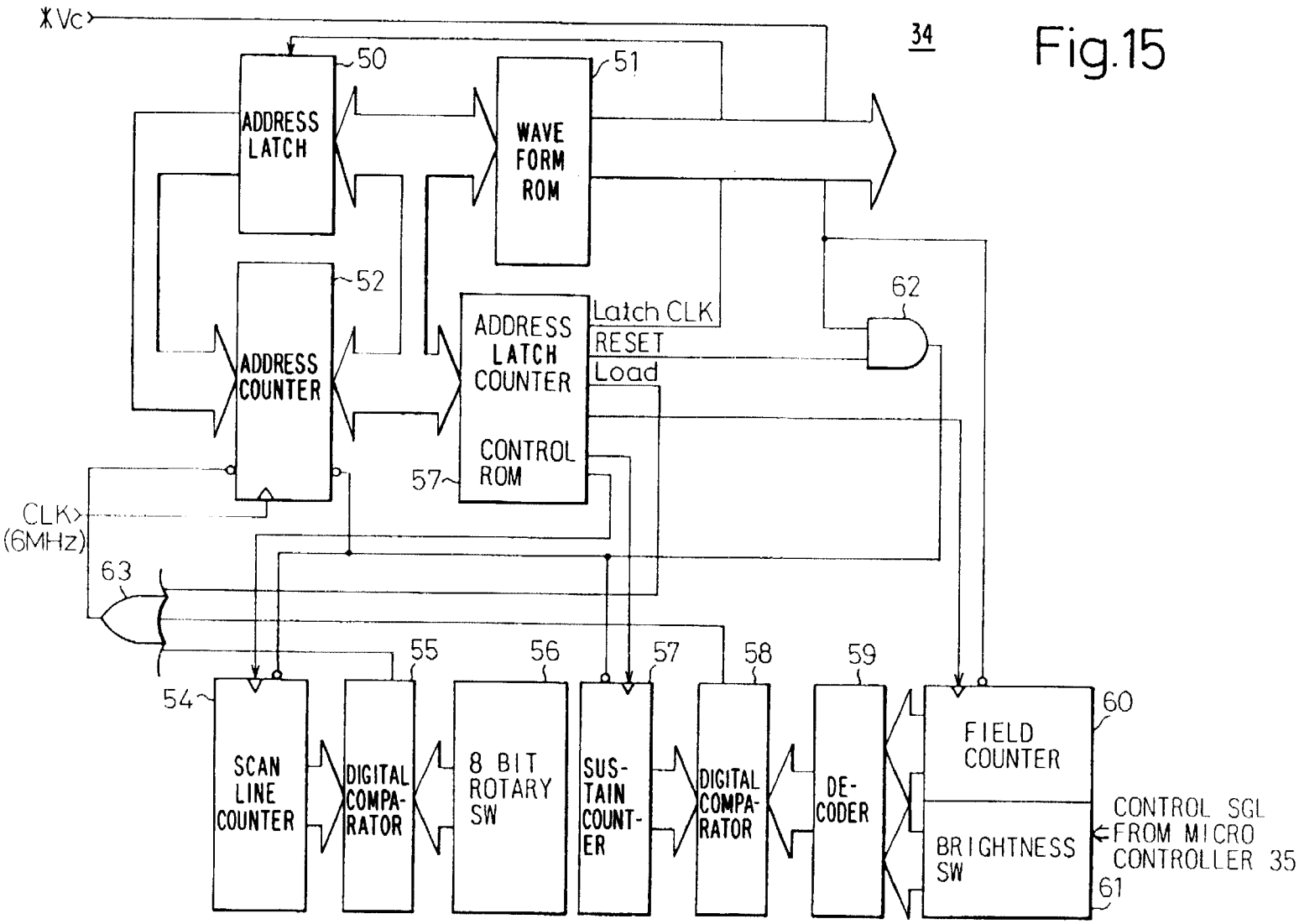
FIG. 15 is a block diagram illustrating the constitution of a scan controller circuit used in the flat-display panel according to the embodiment of this invention.
Figure 16:
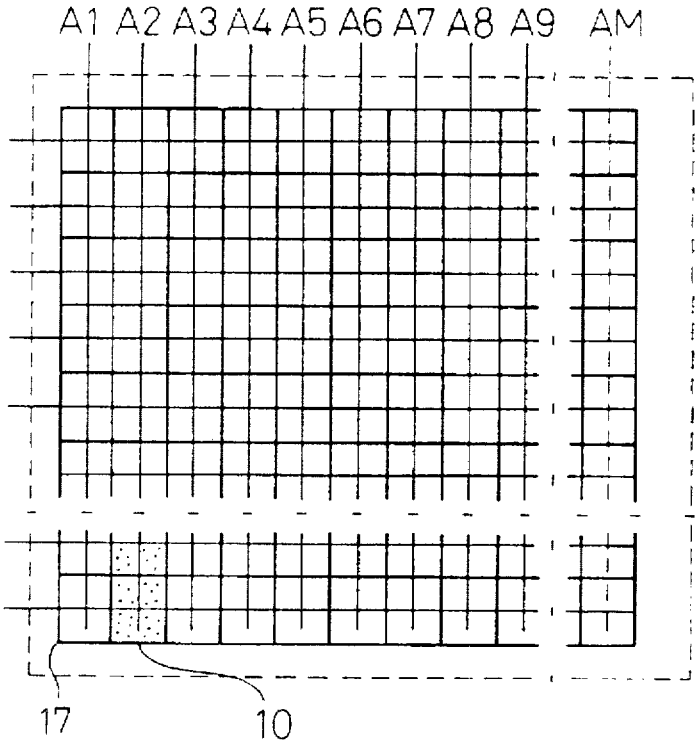
Fig.16 PRIOR ART
FIG. 16 is a plan view illustrating the constitution of a display means employed in a prior art flat-display panel which is a DC-type plasma display.
Figure 17:
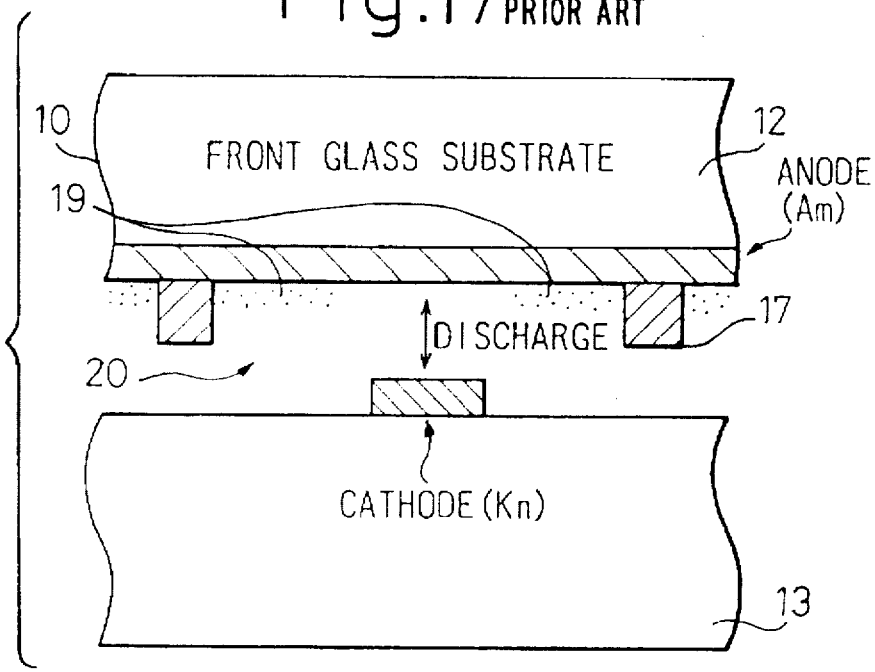
Fig.17 PRIOR ART
FIG. 17 is a sectional view illustrating the constitution of a cell portion in the prior art flat-display panel which is the DC-type plasma display.

Next, the scan control circuit 34 for changing the frequency used in the present invention will be described with reference to the block diagram of FIG. 15 though there is no particular limitation on the constitution thereof.

In an address data batch-writing method in which a waveform program is constituted by a minimum data unit and the address counter of a ROM is arranged so as to loop within the minimum data units, the scan control circuit 34 repeats the operation in which a head address of the minimum data unit of the waveform program is latched and the head address previously latched at the final address of the minimum data unit is loaded into the address counter, and the program is shifted to the next minimum data unit. In the drawing, an input signal Vc causes the blocks to be reset, and the address counter 52 starts operating.

The head address, at which the counted value enters into the scan cycle, is latched by the address latch 50 in response to a latch clock from an address latch counter control ROM 57, and the latched address data is loaded into the address counter 52 in response to a load signal from the address latch counter control ROM 57 at the time of a last address in the scan cycle.

This operation continues until the value of the scan line counter 54 coincides with the value of the 8-bit rotary SW 56 and the load signal is inhibited by the output from a digital comparator 55.

When the load signal is inhibited, the address counter 52 leaves the scan cycle and enters into the sustain cycle. Even in the sustain cycle, the same operation as the scan cycle is carried out at places of the head address and the last address.

The sustain counter 57 counts the number of sustaining pulses and, when the counted value coincides with the output of the comparator 58, the load signal is inhibited and the sustain counter leaves the scan cycle.

At this moment, the output of the comparator 58 is determined by the output state of a field counter 60 and by the output state of a brightness switch 61.

As the sustain counter leaves the sustain cycle, the address counter is reset by a reset signal (RESET) from the address latch counter control ROM 57 and starts operating from the write cycle.

Here, until the next control signal Vc is input, the field counter 60 counts up every time all of the cycles are finished.

In this embodiment, the frequency of the discharge-sustaining pulses is changed by inputting a control signal to the above-mentioned brightness switch SW 61 from the frequency setting means 47 provided in the calculation means 35 which is constituted by a microcontroller or the like in accordance with the present invention.

Figure 4:
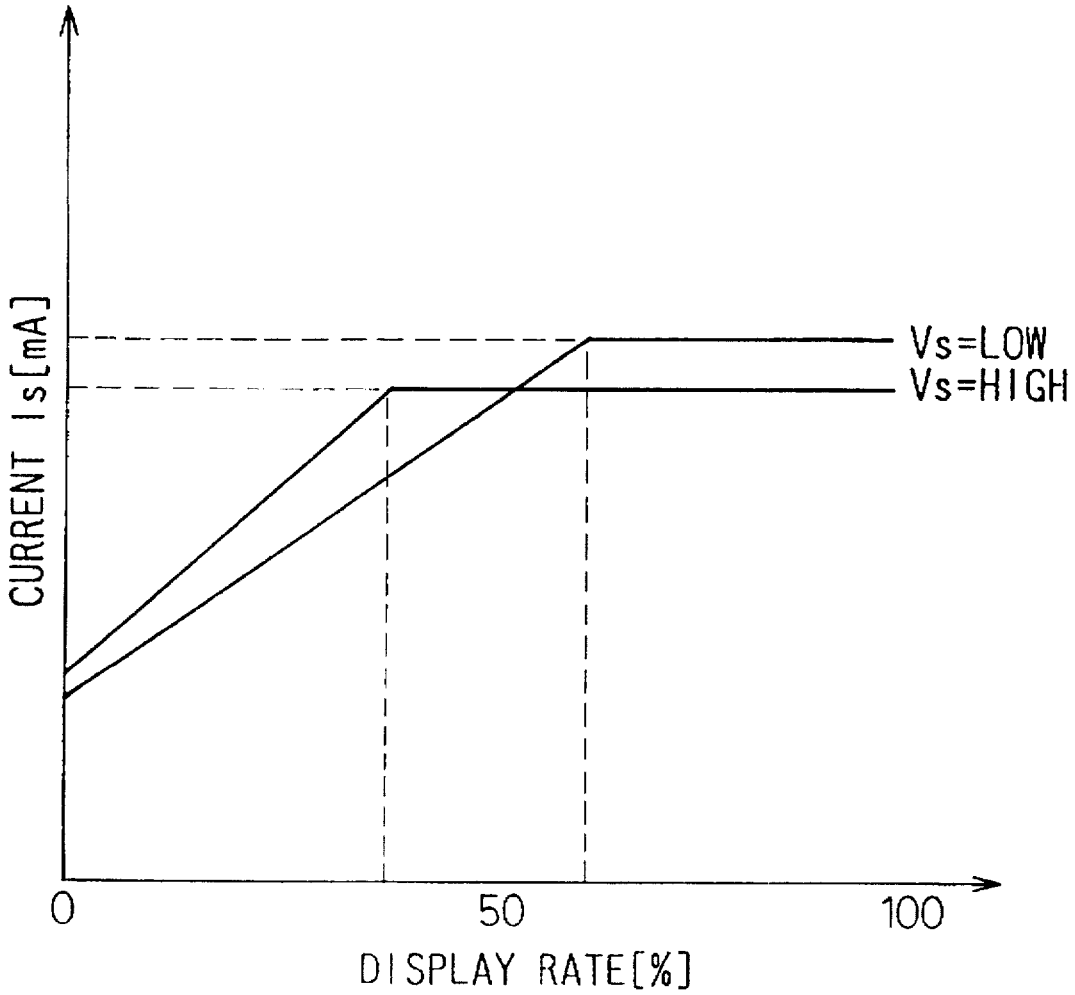
FIG. 4 is a graph showing the relationship between the display rate and the current when the display operation is carried out by the flat-display panel of this invention.
Figure 5:
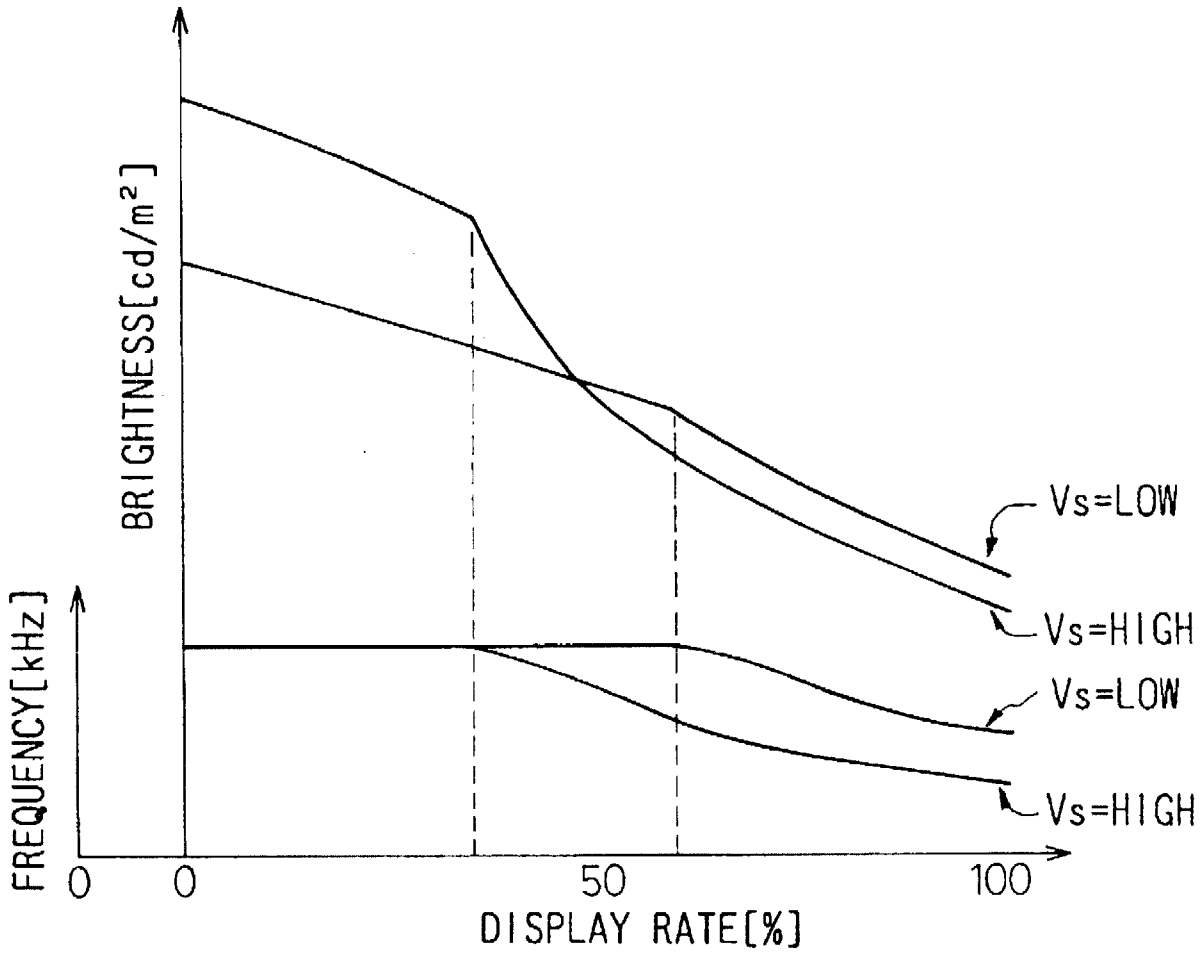
FIG. 5 is a graph showing the relationship between the display rate, the brightness and the frequency when the display operation is carried out by the flat-display panel of this invention.

FIGS. 4 and 5 are graphs showing the effects when the image display scanning is executed by using the aforementioned flat-display panel of the present invention.

That is, according to this invention, the current value to be converged is changed from the conventional fixed system into a variable system, based upon the technical idea of maintaining the electric power constant. Therefore, the state of optimum brightness is easily maintained despite a change in the display voltage Vs.

In short, when the display voltage Vs is low, the frequency is increased to maintain the converging current value Is at an increased level as shown in FIG. 5 . Even when the display rate is large, therefore, the electric power is maintained constant to accomplish a brightness level which is higher than the conventional brightness level.

When the display voltage Vs is high, on the other hand, the frequency is lowered as in the prior art to maintain the converging current value Is at a lowered level. Even when the display rate is large, therefore, the electric power can be controlled to remain constant.

According to this invention, furthermore, the difference in the brightness level due to a difference in the display voltage Vs decreases in a region of high display rate, making it possible to display an image stably and with high quality.

Even when a current value to be converged is different and even when any display voltage Vs is set in this embodiment, the brightness level, in a state where the display voltage Vs is low, can be brought close to the brightness level in a state where the display voltage Vs is high since the electric power is maintained to be not larger than a predetermined value.

Figure 6A:
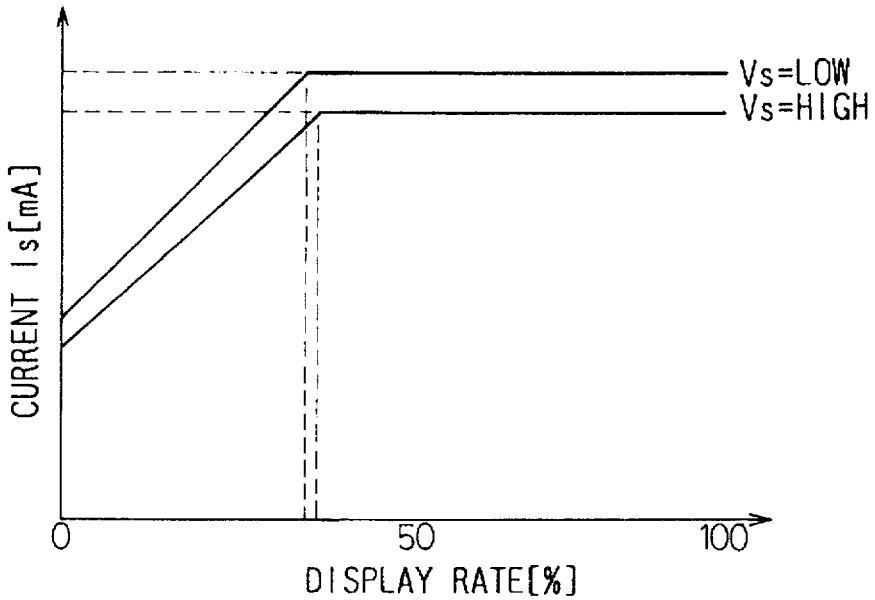
FIG. 6(A) is a graph showing the relationship between the display rate and the current when another display operation is carried out by the flat-display panel of this invention.
Figure 6B:
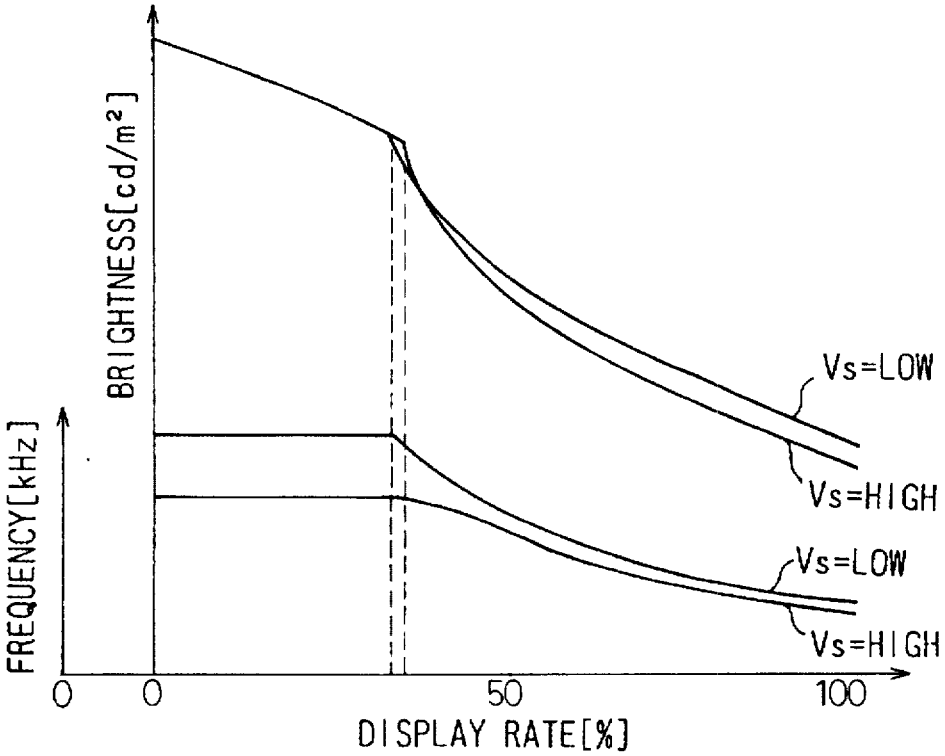
FIG. 6(B) is a graph showing the relationship between the display rate, the brightness and the frequency.
Figure 7:
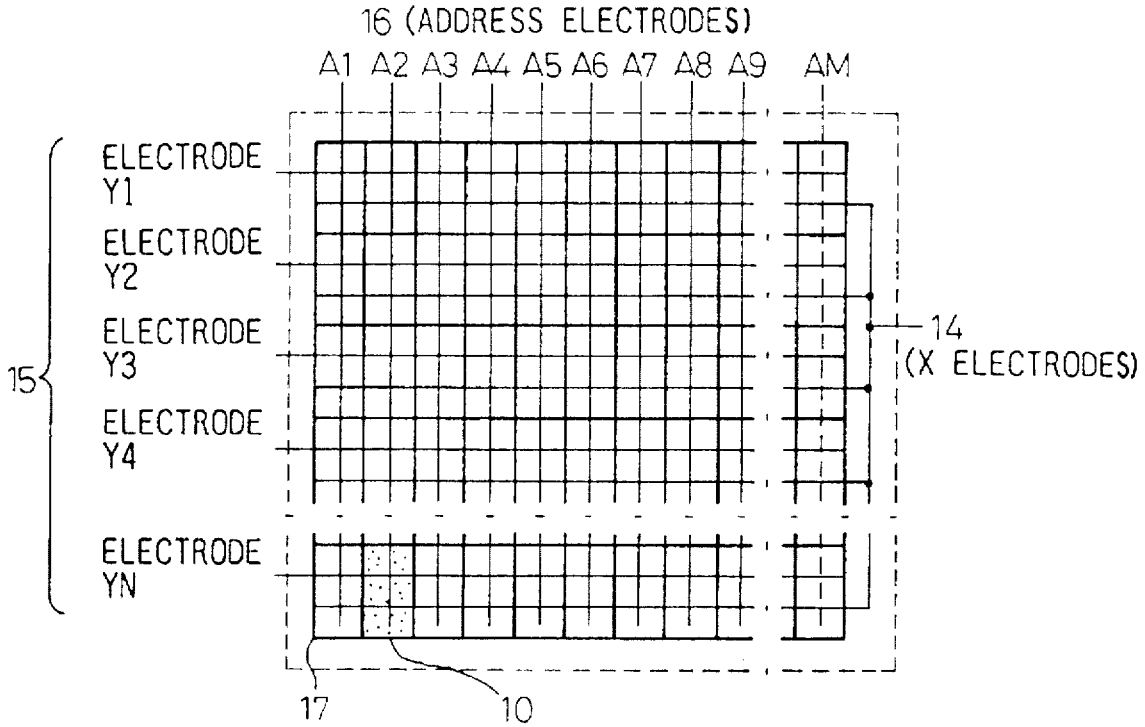
Fig.7 PRIOR ART
FIG. 7 is a plan view illustrating the constitution of a display means employed in a prior art flat-display panel which is an AC-type plasma display.
Figure 8:
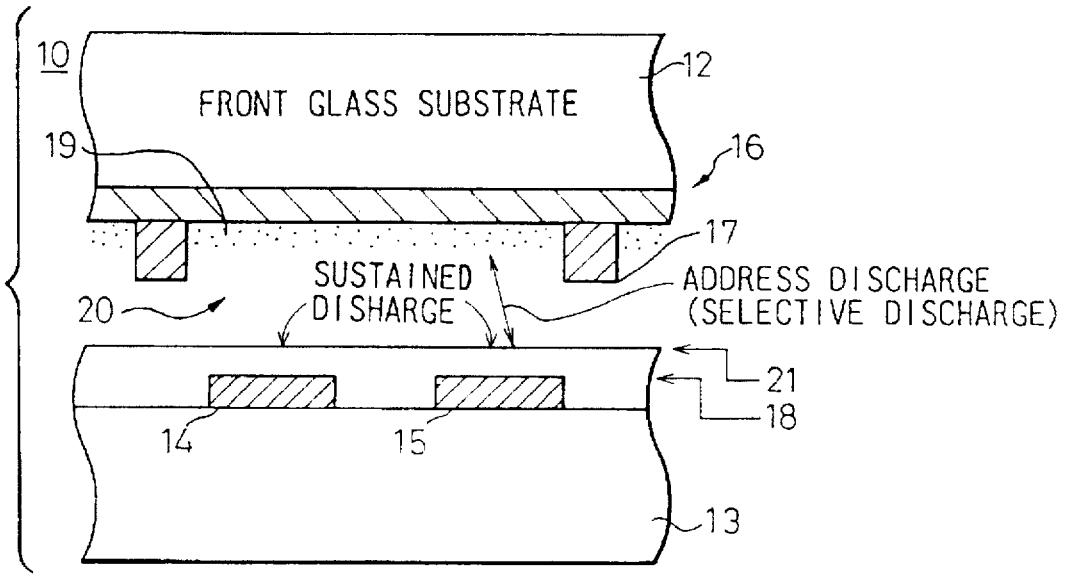
Fig.8 PRIOR ART
FIG. 8 is a sectional view illustrating the constitution of a cell portion in the prior art flat-display panel which is the AC-type plasma display.

FIGS. 6(A) and 6(B) are graphs showing effects obtained by the flat-display panel system according to another embodiment of this invention, wherein the operation as a whole is carried out at higher frequencies by eliminating the difference in the brightness level caused by a difference in the display voltage Vs even when the turn-on frequency is low, and setting the display voltage Vs at a minimum value which does not cause any problem in the display, so that uniform and stable brightness is obtained over the whole range of display rates.

Referring to the relationship between the display rate and the current shown in FIG. 6(A), the frequency is set to be high in order to eliminate a difference in the brightness between when the display voltage Vs is high and when the display voltage Vs is low. It will therefore be recognized that the current is increased, and the control operation is started with a small (i.e., low) display rate in which the current is maintained constant, by the microcontroller 35.

As will be obvious from FIG. 6(B), furthermore, the frequency is adjusted in a region where the display rate is low in order to eliminate the difference in the brightness caused by a change in the display voltage Vs.

As described above, the flat-display panel according to this invention minimizes the difference in the brightness level caused by a difference in the display voltage Vs. Therefore, even when a large multiple display is constituted by arranging a plurality of the flat-displays panel in the form of a matrix, little difference in the brightness is exhibited by the flat-displays panel and the thus constituted large display appears even.

Moreover, a plurality of the displays may be arranged in a cylindrical form to constitute a large public display.

Figure 18:
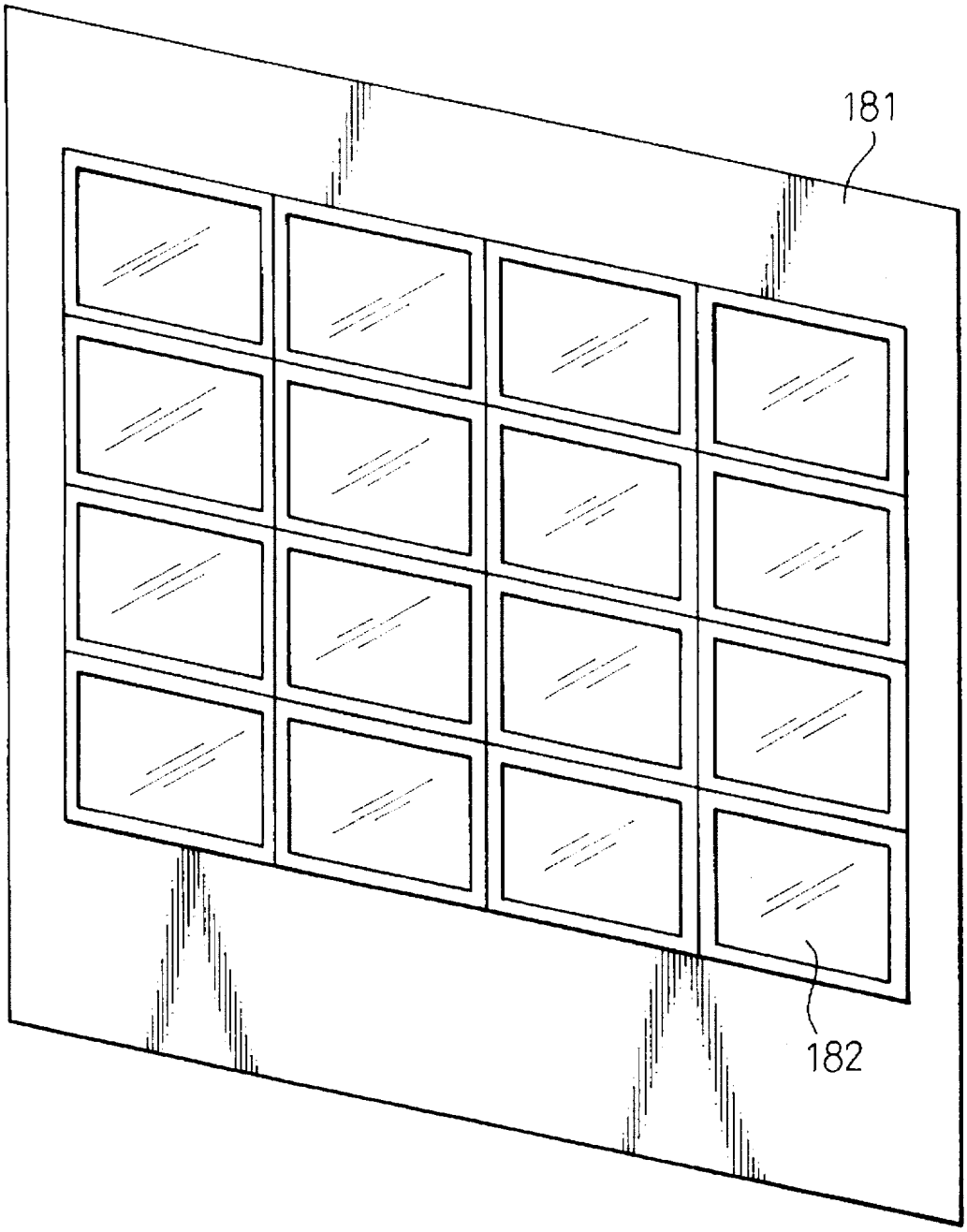
FIG. 18 is a diagram illustrating a large planar display system using the flat-displays panel according to this invention.

FIG. 18 shows the constitution of a large planar display system in which a plurality of displays according to the present invention are arranged in the form of a matrix on a predetermined panel unit 181. In this case, sixteen of the flat-displays panel 182 of the present invention are used.

Figure 19:
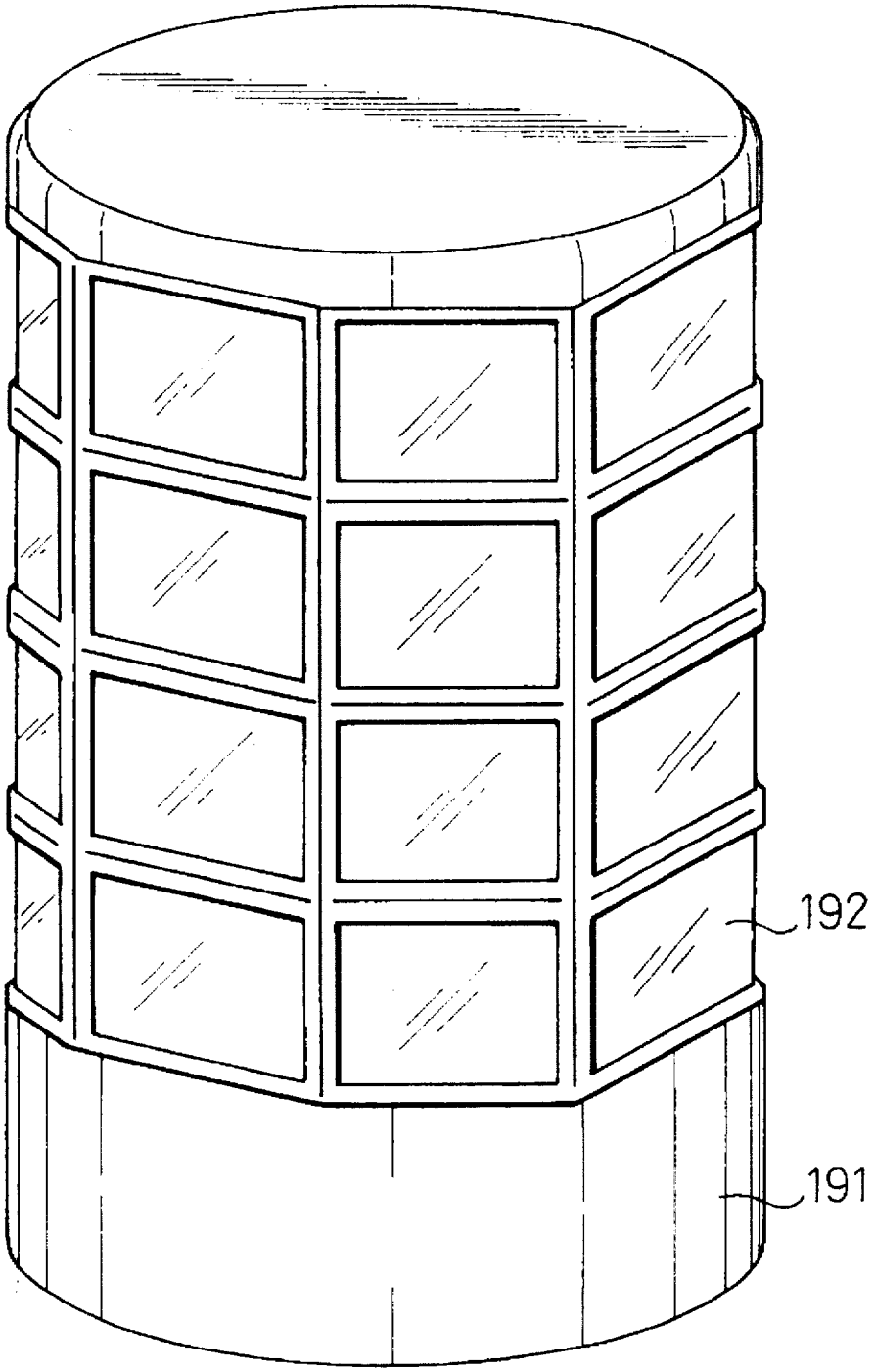
FIG. 19 is a diagram illustrating a large cylindrical display system using the flat-displays panel according to this invention.

FIG. 19 shows a large cylindrical display constituted by arranging thirty-two flat-display panels 192 of this invention in the form of a matrix on the surface of a suitable cylindrical member 191.

Though the method of driving the flat-display panel according to this invention is already obvious from the foregoing description, a basic technical constitution therefor will be briefly described below. According to the first display driving method of controlling the flat-display panel, a current flowing into the display panel 30 is detected in the above-constituted flat-display panel system and the current converging value is set to a given value in response to the detected current so that the current is controlled to acquire a predetermined value. According to the second display driving method of controlling the flat-display panel, in controlling the turn-on display rate, the frequency of the discharge-sustaining voltage pulses is controlled in a manner that the current flowing into the display means is converged into a value set by the preset current converging value.

According to the third display driving method of controlling the flat-display panel, the voltage for turning-on the display applied to the display means is detected in the flat-display panel and, at the same time, the power (voltage× current) value is calculated from an output of the voltage detecting means and an output of the current detecting means, and the frequency of the discharge-sustaining voltage pulses is so controlled that the power value is maintained constant.

According to the fourth display driving method of controlling the flat-display panel, the frequency of the discharge-sustaining voltage pulses is set to a predetermined value in response to the detected display voltage in the above-mentioned methods of driving the flat-display panel.

According to the fifth display driving method of controlling the flat-display panel, control data corresponding to the detected voltage value is stored and, when the voltage is again detected, the control data corresponding to the detected voltage is compared with the stored data to control the display in the above-mentioned methods of driving the flat-display panel.

According to the flat-display panel of the present invention employing the above-mentioned technical constitution, the current converging value is changed depending upon the display voltage Vs thereby to change the frequency, and the difference in the brightness caused by a difference in the display voltage Vs is minimized, making it possible to realize a display maintaining a stabilized brightness.

When the display voltage Vs is low, the current value to be converged is set to a high level in order to increase the frequency of the discharge-sustaining pulses and hence to increase the brightness. Therefore, the brightness level when the display voltage Vs is low is heightened to become close to the brightness level when the display voltage Vs is high, making it possible to decrease a change in the brightness caused by a difference in the display voltage Vs.

According to the present invention, therefore, no limitation is imposed on the display rate making it possible to provide a flat-display panel of a low power consumption type without the same being affected by the display rate. Moreover, the flat-display panel is capable of displaying an image with a stabilized brightness while suppressing a change in the brightness, regardless of a change in the display rate or a change in the display voltage Vs.

We claim:

1. A display panel comprising:

at least two electrode arrays, each array having a plurality of electrodes forming corresponding cell portions that constitute corresponding pixels and each of said cell portions having a function of selectively emitting light in accordance with selection thereof by suitable display data and energization of the selected cell portions by drive voltage pulses applied to said corresponding electrodes and selectively producing a flow of current into the selected cell portions;

a controller controlling the level of the current flowing into the selected cell portions, the level of which increases with an increase in the turn-on display rate of said selected cell portions;

a current detector detecting the level of the current flowing into said cell portions; and a current converging value setting unit arbitrarily setting a converging value of the current flowing into said cell portions.

2. A display panel in accordance with claim 1, wherein said display panel is a plasma display panel.

3. A display panel in accordance with claim 1, wherein said display panel is an electroluminescence display panel.

4. A display panel in accordance with claim 1, wherein each of said cell portions further comprises a suitable fluorescent substance disposed therein.

5. A display panel in accordance with claim 2, wherein said drive voltage pulses comprise discharge-sustaining voltage pulses, each said selected cell portion emitting light upon discharge thereof in accordance with selection thereof by the suitable display data and application thereto of the discharge-sustaining voltage pulses through said corresponding electrodes.

6. A display panel in accordance with claim 1, wherein said controller comprises a turn-on frequency control unit which controls the level of said current based upon a frequency of said drive voltage pulses.

7. A display panel in accordance with claim 6, wherein said turn-on frequency control unit controls the frequency of said discharge-sustaining voltage pulses so that the level of the current flowing into said selected cell portions converges to a current converging value set by said current converging value setting unit.

8. A display panel in accordance with claim 6, wherein said display panel is a plasma display and said drive voltage pulses comprise discharge-sustaining voltage pulses.

9. A display panel in accordance with claim 7, further comprising a voltage detector detecting a turn-on display voltage applied to said cell portions and an electrical power calculator calculating the value of an electrical power supplied to the display panel from the output value of said voltage detector and the output value of said current detector, and wherein said turn-on frequency control unit controls the frequency of said discharge-sustaining voltage pulses so that said power value is maintained constant.

10. A display panel in accordance with claim 9, further comprising a frequency setting unit setting the frequency of said discharge-sustaining voltage pulses at a predetermined value in response to the output of said voltage detector.

11. A display panel in accordance with claim 9, further comprising a storage unit storing control data corresponding to a voltage value detected by said voltage detector, and said turn-on frequency control unit reads out control data corresponding to a detected voltage value from said storage unit and thereby controls said turn-on frequency.

12. A display panel system comprising plural display panels arranged in a desired form, each display panel further comprising:

at least two electrode arrays, each array having a plurality of electrodes forming corresponding cell portions that constitute respective pixels and each of said cell portions having a function of selectively emitting light in accordance with selection thereof by suitable display data and energization of the selected cell Portions by drive voltage pulses applied to said electrodes and producing a flow of current into the selected cell portions;

a controller controlling the level of the current flowing into the selected cell portions, the level of which increases with an increase in the turn-on display rate of said cell portions;

a current detector detecting the level of selected the current flowing into said cell portions; and a current converging value setting unit arbitrarily setting a converging value of the current flowing into said cell portions.

13. A display panel system as recited in claim 12, wherein the desired form is a cylinder.

14. A method of controlling a display panel comprising at least two electrode arrays, each array having a plurality of electrodes forming respective cell portions that constitute corresponding pixels and each of said cell portions having a function of selectively emitting light in accordance with selection thereof by suitable display data and energization of the selected cell portions by drive voltage pulses applied to said respective electrodes and selectively producing a corresponding flow of current into the selected cell portions, comprising:

setting a current converging value to a given value so that the level of the current flowing into said selected cell portions is controlled to a predetermined value;

detecting the level of the current flowing into said cell portions; and controlling said current to have a level of the predetermined value in response to said detected current level.

15. A method of controlling a display panel in accordance with claim 14, wherein said display panel is a plasma display and said drive voltage pulses comprise discharge-sustaining voltage pulses, each said selected cell portion emitting light upon discharge thereof in accordance with selection thereof by the suitable display data and application thereto of discharge-sustaining voltage pulses through said corresponding electrodes.

16. A method of controlling a display panel in accordance with claim 15, further comprising controlling the frequency of said discharge-sustaining voltage pulses in accordance with said set current converging value so that the current flowing into said cell portions converges to the set current converging value.

17. A method of controlling a display panel in accordance with claim 16, further comprising detecting the turn-on display voltage applied to said cell portions, detecting the level of current flowing to the cell portion, calculating the value of electrical power (voltage×current) supplied to the display panel as a product of the detected turn-on display voltage and the detected level of the current flowing to said selected cell portions, and controlling the frequency of said discharge-sustaining voltage pulses so that said power value is maintained constant.

18. A method of controlling a display panel in accordance with claim 15, further comprising setting the frequency of said discharge-sustaining voltage pulses to a predetermined value in response to the detected turn-on display voltage.

19. A method of controlling a display panel in accordance with claim 14, further comprising storing control data corresponding to a detected turn-on voltage value and, when said turn-on voltage value is detected, comparing control data corresponding to the detected voltage value with said stored control data and controlling the frequency of the discharge-sustaining voltage pulses of said display in accordance with the results of the comparison.

20. A display panel system as recited in claim 12, wherein the desired form is a matrix.

* * * * *

UNITED STATES PATENT AND TRADEMARK OFFICE

CERTIFICATE OF CORRECTION

PATENT NO. : 5,745,085

DATED : April 28, 1998

INVENTOR(S) : Shigetoshi TOMIO et al.

It is certified that error appears in the above-identified patent and that said Letters Patent is hereby corrected as shown below:

Col. 14, line 27, change "Portions" to --portions--.

Signed and Sealed this

Twenty-sixth Day of January, 1999

*Attest:*

*Attesting Officer*

*Acting Commissioner of Patents and Trademarks*